US008857065B2

(12) United States Patent
Behbehani

(10) Patent No.: US 8,857,065 B2
(45) Date of Patent: Oct. 14, 2014

(54) TRAINING SPOON

(76) Inventor: Fawzi Q. Behbehani, Abdula Mubarak (KW)

( * ) Notice: Subject to any disclaimer, the term of this patent is extended or adjusted under 35 U.S.C. 154(b) by 183 days.

(21) Appl. No.: 13/116,426

(22) Filed: May 26, 2011

(65) Prior Publication Data

US 2012/0297629 A1 Nov. 29, 2012

(51) Int. Cl.
*A47G 21/04* (2006.01)

(52) U.S. Cl.
CPC ..... *A47G 21/04* (2013.01)
USPC ..... 30/324

(58) Field of Classification Search
USPC ..... 30/324, 322, 298.4, 325, 149, 113.1, 30/113.3, 143, 328; D7/693, 647, 678; 99/495, 510; 241/95
See application file for complete search history.

(56) References Cited

U.S. PATENT DOCUMENTS

| | | | | | |
|---|---|---|---|---|---|
| 724,246 | A | * | 3/1903 | Bentley | 416/70 R |
| 885,444 | A | * | 4/1908 | Cram | 416/70 R |
| 2,536,065 | A | * | 1/1951 | Kollander | 452/105 |
| 2,688,243 | A | * | 9/1954 | Bowen | 68/213 |
| 4,835,864 | A | | 6/1989 | Tang | |
| 6,134,790 | A | | 10/2000 | Watson | |
| D437,737 | S | | 2/2001 | Durbin et al. | |
| 6,701,625 | B1 | | 3/2004 | Thomason et al. | |
| D491,425 | S | | 6/2004 | Rosenthal | |
| 6,898,857 | B2 | | 5/2005 | Ruben | |
| D536,934 | S | | 2/2007 | Huber | |
| D594,122 | S | * | 6/2009 | Mettler, Jr. | D24/136 |
| 2005/0066529 | A1 | * | 3/2005 | Ruben | 30/149 |
| 2005/0091854 | A1 | * | 5/2005 | Johnson | 30/324 |

* cited by examiner

*Primary Examiner* — Ghassem Alie
(74) *Attorney, Agent, or Firm* — Lowe Hauptman & Ham, LLP

(57) ABSTRACT

A training spoon for training an individual not to bite down on a spoon includes a longitudinally extending handle and a spoon shaped head portion integral with or attached to the handle. The head portion defines a relatively shallow concave bowl with a plurality of generally parallel alternating transverse ridges and adjacent grooves extending across a majority of the width of the head portion of the spoon.

1 Claim, 1 Drawing Sheet

TRAINING SPOON

FIELD OF THE INVENTION

This invention related to a training spoon and more particularly to a training spoon for teaching an individual not to bite down on a spoon.

BACKGROUND OF THE INVENTION

Spoons are commonly provided in table settings and commonly used by individuals as an utensil for eating a variety of foods such as hot or cold cereals, soup and some vegetables such as peas. A number of variations of common spoons are also known. For example, a Tang U.S. Pat. No. 4,835,864 discloses a combination fork/spoon utensil. As described therein, a combination utensil capable of being alternatively used as a fork and a spoon comprises an elongate handle, a spoon-shaped head attached to the handle, and a moveable plate. The spoon-shaped head has a cut out portion at its forward end. The cut out portions provide at least two tines. The plate is capable of being moved between two positions. In one position, the plate substantially covers the cut out portion of the head and the utensil forms a spoon. In the other position, the cut out portion of the head is substantially uncovered and the utensil forms a fork.

A more recent Watson U.S. Pat. No. 6,134,790 discloses a utensil for children wherein the utensil includes a planar flexible handle portion and a semi-rigid utensil portion. The utensil portion includes a ridge and a handle which engages the handle portion. A mouth guard is included and is disposed at the junction of the handle and utensil portion. Included among the utensils are a spoon, fork and toothbrush. A kit of utensils is also disclosed.

Finally, a spoon for peeling fruit is disclosed in a U.S. Pat. No. 6,898,857 of Ruben. As disclosed therein a hand utensil for peeling and pitting a fruit, such as a mango, has a spoon-shaped bowl through which a plurality of elongated generally parallel slots laterally extend in a lower region of the concave surface between the proximal end and the distal end of the bowl. In addition, a series of arcuate ridges project form the concave surface of the bowl, wherein each arcuate ridge has a radius of curvature extending from a center point on a longitudinal axis defined by the bowl.

Notwithstanding the above, it is presently believed that there is a need and a potentially commercial market for an improved training spoon for training individual's not to bite down on a spoon. There should be a market for such spoons because they provide an audible warning when an individual bites down on a spoon and trains an individual to avoid the likelihood of cracking or chipping a tooth and for making an objectionable noise while eating. Further, the spoons in accordance with the present invention can be produced at a competitive price, are durable and have the overall appearance of a regular spoon.

BRIEF SUMMARY OF THE INVENTION

The invention contemplates a feeding spoon for training an individual not to bite down on the spoon. The training spoon includes a longitudinal extending handle and a spoon shaped tip portion having a length and width integral with or connected to the handle at one end thereof along a longitudinal axis. The tip portion defines a relatively shallow concave bowl with a plurality of generally parallel alternating transverse ridges and grooves extending across a majority of the width of the tip portion of the spoon.

The invention will now be described in connection with the accompanying figures wherein like reference numerals have been used to indicate like parts.

DESCRIPTION OF THE PREFERRED EMBODIMENTS OF THE INVENTION

Figure 1:
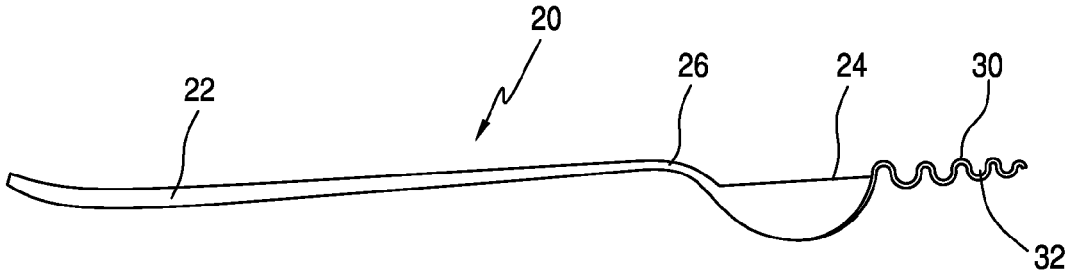
FIG. 1 is a side elevational view of a training spoon in accordance with a first embodiment of the invention.
Figure 2:
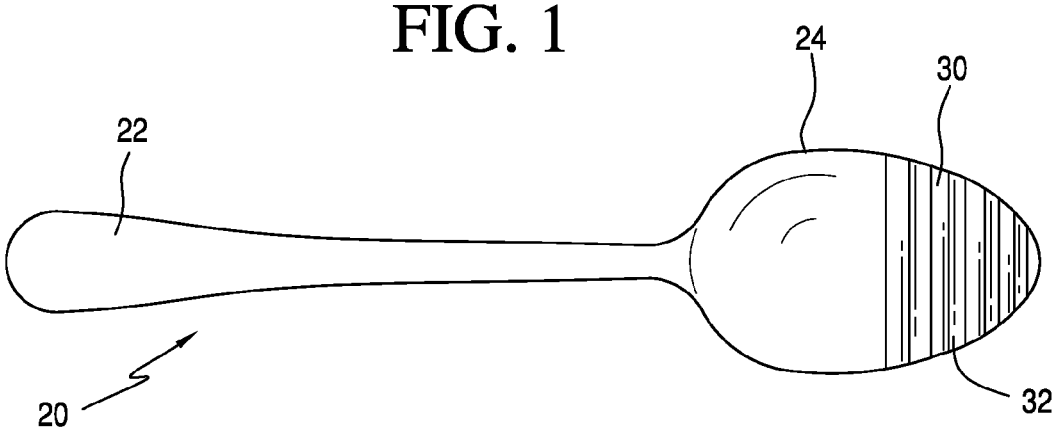
FIG. 2 is a top or plan view of the training spoon shown in FIG. 1.
Figure 3:
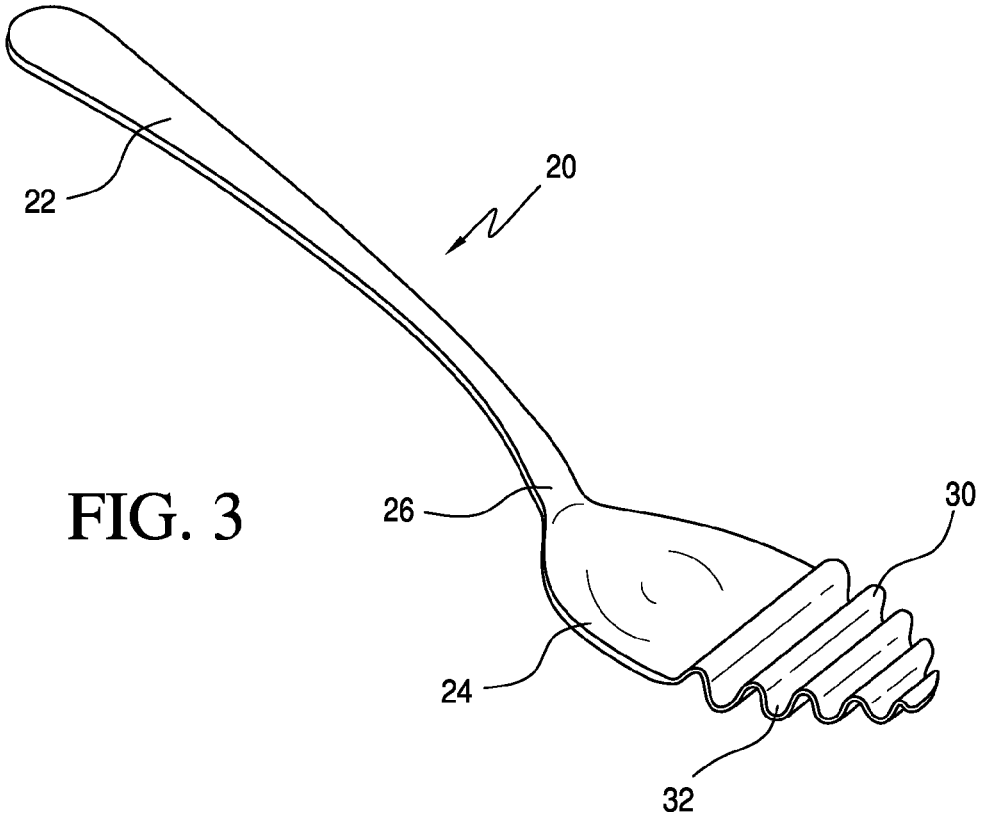
FIG. 3 is a perspective view of the training spoon shown in FIGS. 1 and 2.

FIGS. 1-3 illustrates a preferred embodiment of the invention wherein a training spoon 20 includes a longitudinally extending handle 22 and a head portion 24 that is integral with the handle 22 or attached thereto at a distal end thereof. As illustrated, the handle and head lie along a longitudinal axis. The handle 22 has a relatively flat cross section that merges into the integral head portion 24 that is stamped out of sheet metal in a conventional manner.

In a preferred embodiment of the invention, the head portion 24 defines a generally oval shape with a relatively shallow bowl shape and a length of between about 1½ to 2½ inches (3.81 to 6.35 cm) preferable about 2 inches (5.08 cm), a width of between ¾ to 1¼ inches (1.90 to 3.175 cm) preferably about 1 inch (2.54 cm) and a depth of between ⅜ inch and ⅝ inch (0.953 and 1.587 cm) and preferably about ½ inch (1.25 cm).

The handle 22 has a length of about 3½ to about 6½ inches (8.89 to 16.51 cm) and preferably about 4 inches (10.16 cm). The spoon 20 is preferably made of a dishwasher safe food grade material such as cutlery stainless steel SAE51335 or other metal or alloy as commonly used in manufacturing eating utensils. However, it is also contemplated that the training spoon might be made of hard plastic with a metallic coating. The shortcoming of hard plastic is that it does may make a clear sound when the teeth strike it.

The spoon 20 also includes the longitudinally extending handle 22, head portion 24 and a neck 26 between the handle 22 and the head portion 24. The head portion also includes 3 to 5 raised ridges 30 that extend in relatively straight lines across the width of the head portion of the spoon between about 60% to 80% of the width of the spoon and 4 to 6 grooves 32 that are parallel to and adjacent to the raised ridge 30. The raised ridges 30 have a height of between about ⅛ inch and ¼ inch (0.318 to 0.635 cm) preferably about 3/16 inch (0.476 cm). These raised ridges 30 are separated by the parallel grooves 32 that have a width of between about ⅛ inch to about ¼ inch (0.635) to preferably about 3/16 inch (0.476 cm).

In the preferred embodiment of the invention four raised ridges and five adjacent grooves cover about 44% to about 50% of the length of the head portion and preferably about 47% thereof.

When an individual bites down on the training spoon, their upper teeth encounter the top of one of the ridges and their bottom teeth probably engages one of the ridges and as the individual bears down with slight pressure their upper teeth slip off of the top of one of the ridges and strikes the bottom of one of the grooves. This results in a relatively loud "clicking" sound. When this occurs, the individual is or has been counseled to immediately relax the pressure on the head portion of the spoon. Then after a number of time the individual learns not to bite down on the spoon.

While the invention has been described in connection with its preferred embodiments it should be recognized that changes and modifications may be made therein without departing from the scope of the appended claims.

What is claimed is:

1. A method for training an individual not to bite down on a spoon, said method consisting of the following steps:

providing a training spoon consisting of:

a longitudinally extending dishwasher safe metal handle having a length of about four inches and a spoon shaped dishwasher safe head having a length of about 2 inches, a width of about 1 inch and a depth of about ½ inch integral with said handle and wherein said handle and head are disposed along a longitudinal axis and made of SAE51335 stainless steel and four generally parallel relatively straight ridges alternating with said five generally straight adjacent grooves extending across about 75% of said width with centers in the center of said head and said ridges having a height of about $3/16^{th}$ of an inch and said adjacent grooves having a width of about $3/16^{th}$ of an inch and wherein said ridges and grooves cover approximately 50% of said length of said head portion of said spoon;

wherein said head has a peripheral edge, and wherein said head has a concave shape with a smooth outer surface and without any ridges, wherein said handle extends substantially horizontally from said peripheral edge, and said ridges extend from said peripheral edge opposite said handle;

advising said individual to release the pressure on said spoon each time that the individual hears the noise of his/her teeth slipping off of one of said ridges and striking a bottom of one of said grooves.

* * * * *